United States Patent [19]

Kurita

[11] 4,239,370

[45] Dec. 16, 1980

[54] ELECTROPHOTOCOPYING MACHINE FOR PRODUCTION OF COLORED PHOTOCOPIES

[75] Inventor: Takaji Kurita, Kawachinagano, Japan

[73] Assignee: Minolta Camera Kabushiki Kaisha, Osaka, Japan

[21] Appl. No.: 861,006

[22] Filed: Dec. 15, 1977

[30] Foreign Application Priority Data

Dec. 20, 1976 [JP] Japan ..... 51-153817
May 17, 1977 [JP] Japan ..... 52-57258

[51] Int. Cl.[3] ..... G03G 15/01
[52] U.S. Cl. ..... 355/4; 355/3 SH
[58] Field of Search ..... 355/3 R, 3 SH, 1, 4

[56] References Cited

U.S. PATENT DOCUMENTS

| | | | |
|---|---|---|---|
| 2,986,466 | 5/1961 | Kaprelian | 355/4 X |
| 3,330,190 | 7/1967 | Taillie | 355/1 X |
| 3,398,669 | 8/1968 | Hicks | 355/1 |
| 3,690,756 | 9/1972 | Smith | 355/4 |
| 3,955,888 | 5/1976 | Kakiuchi et al. | 355/1 |
| 4,129,373 | 12/1978 | Ogura et al. | 355/1 |

FOREIGN PATENT DOCUMENTS

| | | | |
|---|---|---|---|
| 46-13478 | 9/1971 | Japan | 355/4 |

*Primary Examiner*—Fred L. Braun
*Attorney, Agent, or Firm*—Wenderoth, Lind & Ponack

[57] ABSTRACT

Electrophotocopying machine in which colored photocopies are produced by successive production and transfer onto copy paper of different color component portions of an original document, and the exposure mechanism for production of each colored component portion employs an optical fiber bundle and an odd number of mirrors, whereby the construction is made more compact and copy paper may be moved in the same direction as an original document, thus facilitating synchronization of movement to ensure correct matching of different component portions of an image at different transfer stations. To further ensure correct matching despite use of different types of copy paper, there is provided a device for adjusting the length of the path over which copy paper is transported between transfer stations.

4 Claims, 7 Drawing Figures

ELECTROPHOTOCOPYING MACHINE FOR PRODUCTION OF COLORED PHOTOCOPIES

The present invention relates to an electrophotocopying machine. More particularly, the invention relates to an electrophotocopying machine which comprises a plurality of means for image formation on a photosensitive medium and means for image transfer onto copy paper permitting production of a colored image, and in which said original document and said copy paper are moved in the same direction during a photocopying process.

It is known that it is theoretically possible to produce a colored photocopy of a colored original document by a suitable combination of the three primary colors cyan, magenta and yellow, it being required to effect formation of an image of an original document on a photosensitive medium and transfer of the image from the photosensitive medium to copy paper for production of suitable photocopy portions colored with each of these colors. That is, a sheet of copy paper for carrying a colored image must either be brought by roll means to a transfer station three times and have transferred thereonto different colored portions each time it arrives at the transfer station, or be carried past three different transfer stations for transfer onto the copy paper of the three different colored portions. A requirement for production of colored photocopies of good quality is that the abovenoted colors be present in precise amounts in precise areas of the copy paper, and in practical equipment there is a problem that it is difficult to ensure transport of copy paper which is precisely synchronized with the movement of the photosensitive medium which ensures that exactly the same portions of the copy paper and original document image are brought into line each time the copy paper passes the transfer station or stations.

A process in which copy paper is successively brought to the same transfer station resolves this problem in a comparatively simple manner, but as such a process involves the use of a single photosensitive medium for production of an image of all colored portions of an original document, the associated exposure means and other elements become extremely complex, in addition to which it is difficult to maintain the qualities of the photosensitive medium for prolonged periods.

In equipment in which copy paper is brought to three separate transfer stations, such as disclosed in Japanese Patent Laid Open Publication Nos. 50-42821 and 51-17444, it is proposed to make the distance between successive transfer stations the same as the distance between successive exposure stations at which photosensitive drums are exposed to image light from an original document. Such an arrangement presumes that the quality and characteristics of the paper material of the original documents and of the copy paper remain constant. However, the quality of the material both of the copy paper and of the original may vary in different photocopying processes, and although it is known to overcome problems of variation in paper quality of original documents by transporting original documents on an effectively rigid support through the photocopying equipment, e.g. the copy paper is moved through the photocopying equipment by roll means, it can happen, for example, that a less rigid sheet of copying paper travels over a slightly longer path between successive pairs of rolls for forwarding the copy paper through the equipment, resulting in misalignment of copy paper and original document image portions. In conventional equipment, synchronization of the movement of copy paper and an original document is further complicated by the fact that the copy paper and original documents are moved in opposite directions.

To compensate for this, it has been proposed to provide photosensitive means and exposure means the positions of which are adjustable, but adjustment of such means may easily result in the exposure means as a whole or elements thereof being moved out of the correct position relative to the photosensitive medium.

A requirement for most types of photocopying equipment is compactness, and considerable contribution to such compactness is made by employment in the exposure system of optical fiber bundles in the manner disclosed in U.S. Pat. No. 3,955,888. Such means, however, while providing advantages with respect to a photocopying machine for production of black and white photocopies presents various problems when employed in an image transfer type color copier. In addition, if optical fiber bundles are employed as an exposure means, an original document and the corresponding portion of a photosensitive means to be exposed to the image of the original document should be moved together in the same direction, whereby the exposed portion of the photosensitive means, which is formed in an endless configuration may be moved for transferring the image onto a copy paper in the opposite direction to the original document and, therefore, the original document and the copy paper are moved past each other in opposite directions. Accordingly, such means can not handle one image in the application of a plurality of images successively onto one copy paper by employment of plural colored image formation means.

It is accordingly a principal object of the present invention to provide a compact electrophotocopying machine for production of colored photographs.

It is another object of the invention to provide an electrophotocopying machine for production of colored photocopies which comprises a succession of transfer stations and a succession of exposure stations and in which each exposure station comprises an optical fiber bundle and an odd number of mirrors, whereby the copy paper may be moved in the same direction as an original document and synchronization of movement of copy paper and original documents is simplified.

It is a further object of the invention to provide an electrophotocopying machine for production of colored photocopies which comprises means for adjusting the length of the path over which copy paper is transported between successive transfer stations, whereby photocopies of good quality may be produced with different types of copy paper.

In accomplishing these and other objects, there is provided according to the present invention, an electrophotocopying machine comprising a succession of rotatable photosensitive drums, and a succession of associated exposure stations and transfer stations. Each drum serves for production of the image portions of an original document carrying a particular color component, and the associated exposure station comprises an optical fiber bundle and an odd number of mirrors, an original document being brought to successive exposure stations while copy paper is brought to successive transfer stations. Use of optical fiber bundles ensures greater compactness of the photocopying machine, while use of an odd number of mirrors in the exposure station permits movement of the copy paper in the same direction as an original document as well as in the same general direction as the photosensitive drum portions at the transfer stations. To make possible adjustment of the length of the copy paper path between transfer stations in accordance with the properties of the copy paper, the invention further provides roll or guide plate means which contact the copy paper and which are movable in a direction which is generally at right angles to the direction followed by the copy paper being moved between transfer stations.

A better understanding of the present invention may be had from the following full description of several preferred embodiments thereof when read in reference to the attached drawings wherein like numbers refer to like elements, and in which.

Figure 1:
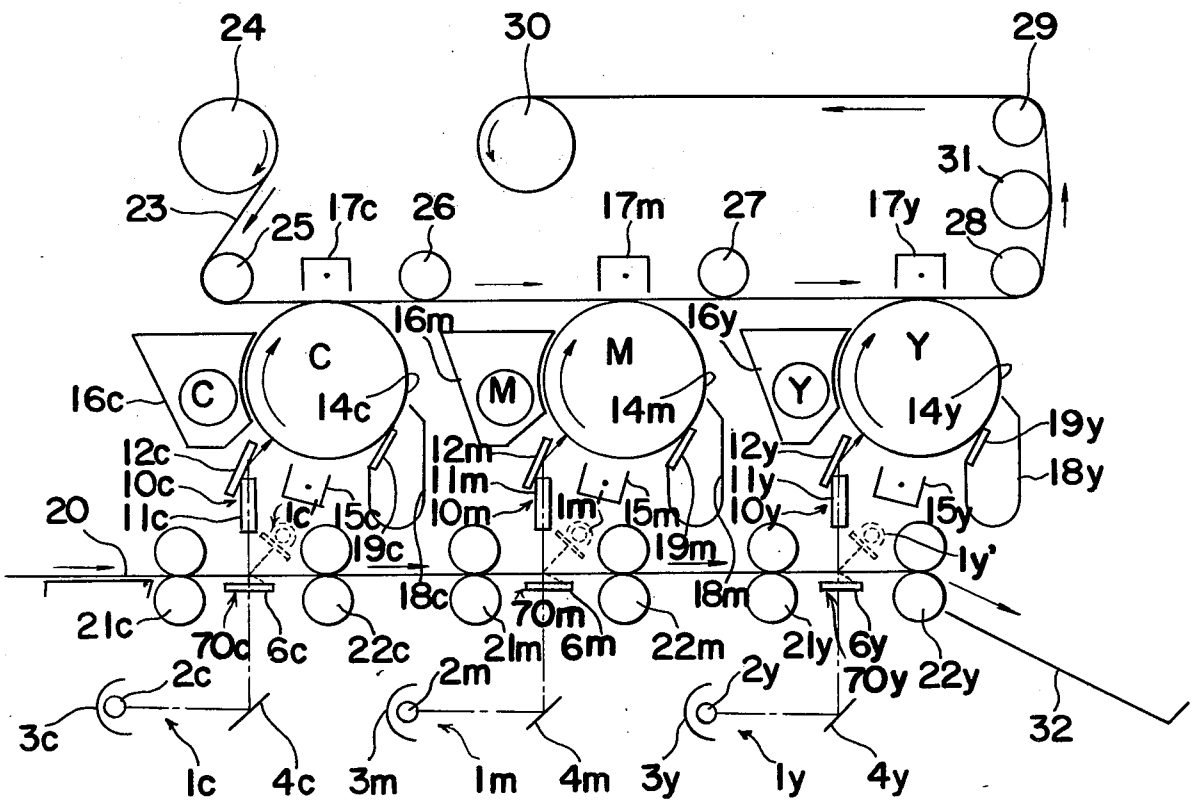
FIG. 1 is a schematic cross-sectional view showing the main elements of an electrophotocopying machine for production of colored photocopies according to a first embodiment of the invention.
Figure 2:
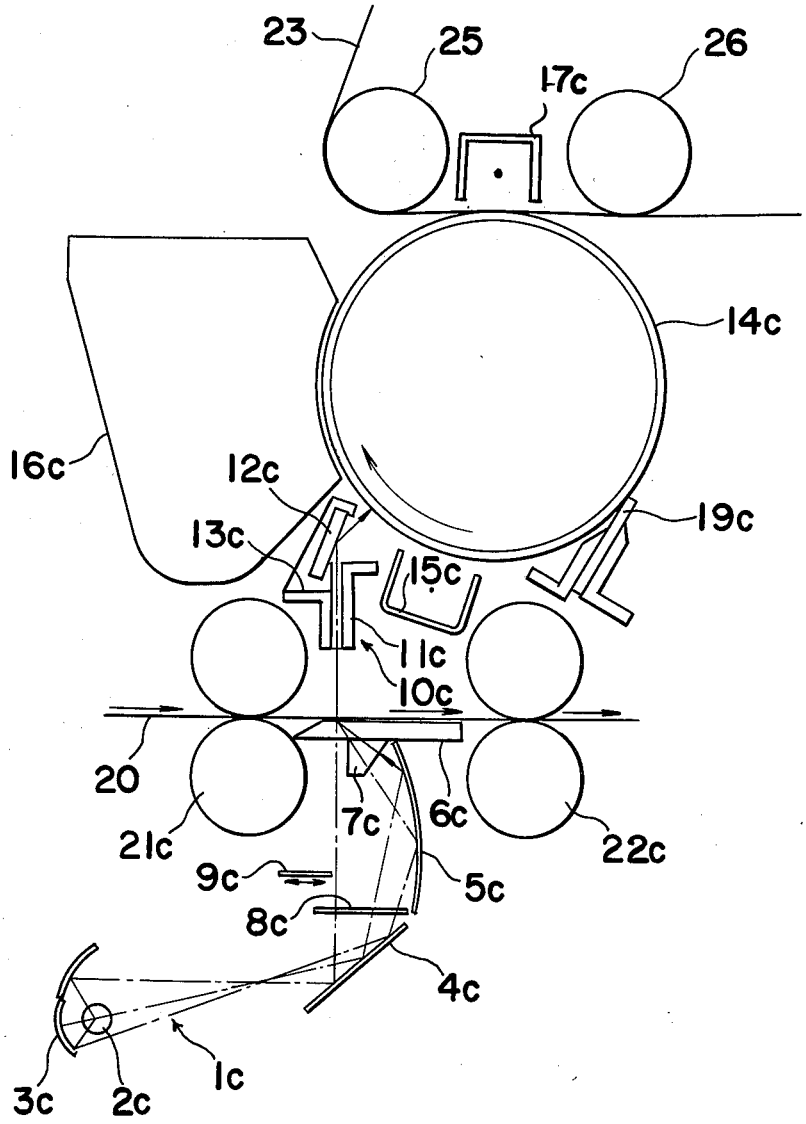
FIG. 2 is a schematic cross-sectional view showing further details of a main portion of the machine of FIG. 1.

Referring to FIG. 1, there is shown a series of synchronously rotatable photosensitive drums 14*c*, 14*m* and 14*y* which are respectively employed for production of images of the cyan, magenta, and yellow component of an original document 20 which is carried over transparent document supports 6*c*, 6*m* and 6*y* at exposure stations 70*c*, 70*m* and 70*y* illuminated by illuminating assemblies 1*c*, 1*m* and l*y* associated with the successive photosensitive drums 14*c*, 14*m* and 14*y* by successive pairs of forwarding rolls 21*c*, 22*c*, 21*m*, 22*m*, 21*y* and 22*y*. The construction of each photosensitive drum and of the elements associated therewith is basically the same, and therefore a detailed description of only the photosensitive drum 14*c* will be given, with reference to FIGS. 1 and 2.

Illuminating assembly 1*c* comprises light source 2*c* and reflector 3*c* which directs light emitted by light source 2*c* onto a flat reflector 4*c* which directs the light at a small angle of incidence onto the portion of the original document 20 which is currently on the transparent support 6*c*. The original document 20 is transported through the electrophotocopying machine with the information carrying surface thereof facing the transparent support 6*c*, and the image of the original document 20 is transmitted to a focussing assembly 10*c* by light passing through the original document.

The flat reflector 4*c* also directs light onto a curved reflector 5*c* which directs the light through a prism 7*c* to impinge at a large angle of incidence on the original document 20. The curved reflector 5*c* is provided since, depending on the texture of the paper constituting the original document 20, light impinging thereon at a small angle of incidence may be insufficient to effect efficient transmission of light therethrough, but efficient transmission is effected if light impinges thereon at a variety of angles of incidence. Further, for normal types of paper used for original documents portions which appear dark when illuminated by light rays impinging at a small angle of incidence usually appear light when illuminated by light rays impinging at a large angle of incidence, and vice-versa. Depending on the form of the information carried by an original document, therefore, it may be desirable to adjust the relative amounts of light directed thereonto by the reflectors 4*c* and 5*c*, and there is accordingly provided a shutter element 9*c*, which is movable to allow passage of greater or smaller amounts of light reflected by the reflector 4*c* towards the document support 6*c*.

If the original document 20 is opaque paper, illumination may be effected by a single lamp and reflector means 1*c*′, 1*m*′ and 1*y*′ such as indicated by the dashed line portion of FIG. 1. In this case, the copy paper 23 should be transparent such as tracing paper for viewing from behind thereof.

Before passing through the transparent support 6*c* or impinging on the curved reflector 5*c*, light reflected from the flat reflector 4*c* passes through a filter 8*c* which is colored red, that is the complementary color of cyan.

The filters 8*m* and 8*y* associated with the photosensitive drums 14*m* and 14*y* for production of images of the magenta and yellow colored portions of the original document are respectively green and blue, that is the complementary colors of magenta and yellow.

The focussing assembly 10*c* comprises an optical fiber bundle 11*c* and full reflecting mirror 12*c* which are positioned at a station for exposure of the photosensitive drum 6 and are both fixedly held in a support 13*c*. The optical fiber bundle 11*c*, which has the advantages of simplicity of construction and compactness, as noted above, serves to produce a focussed erect image of cyan color component portions of the original document 20, and the mirror 12*c* directs the image light onto successive portions of the photosensitive drum 14*c* which is currently rotated at a speed which is selected in reference to the speed of forwarding of the original document 20 through the electrophotocopying machine and is suitable such that the peripheral speed of the drum forwarding speed of the original document, whereby a latent image of the cyan color component portions of the original document 20 is produced on the drum 14*c*.

Prior to coming to the exposure station, peripheral portions of the drum 14*c* are charged by a corona discharge unit 15*c*, and after these peripheral portions pass the exposure station the image carried thereby is developed, for example by cyan colored toner particles applied thereonto by a magnetic brush or similar known means in a development unit 16*c*. The developed image is then transferred onto copy paper at a transfer station described below, after which remnant toner is removed from the drum 14*c* by a cleaning unit 18*c* including a scraper blade 19*c*. There may of course also be provided in association with the drum 14*c* other known elements, such as an erase lamp for removal of charge from the drum portions which have passed the transfer station.

At the transfer station, copy paper 23 is brought into effective contact with the drum 14*c* while the rear surface thereof is charged by a corona discharge unit 17*c* to a potential sufficient to cause transfer of toner particles from the drum 14*c* onto the front surface of the copy paper 23. Similar transfer of magenta colored and yellow colored components of the image of the original document 20 is effected at transfer stations associated with the photosensitive drums 14*m* and 17*y*, the combination of these various colored components resulting in a photocopy which is colored in correspondence to the original document 20.

Copy paper 23 is supplied from a roll 24 of paper and is wound up by a wind-up unit 30 which is generally level with the supply roll 24 after being guided as a continuous sheet around a generally rectangular path by a roller 25 which is vertically below the supply roll 24, rollers 26, 27 and 28 which are level with the roller 25 and together therewith serve to carry the copy paper 23 past successive transfer stations and a roller 29 which is vertically above the roller 28 and level with the wind-up unit 30. Between the rollers 28 and 29, there is provided a heating roll 31 which serves to cause fusion and fixing of image-defining toner particles on the copy paper 23. After being wound up by the wind-up unit 30, the copy paper 23 is cut to a suitable length, generally corresponding to length of the original document 20, by cutter means not shown. As noted earlier, by the provision of an odd number of mirrors in each of the focussing assemblies 10, it is possible to move copy paper 23 through the photocopying machine in the same direction as the original document 20, and synchronization of movement of the copy paper 23 and original document 20 is therefore greatly simplified.

Figure 3:
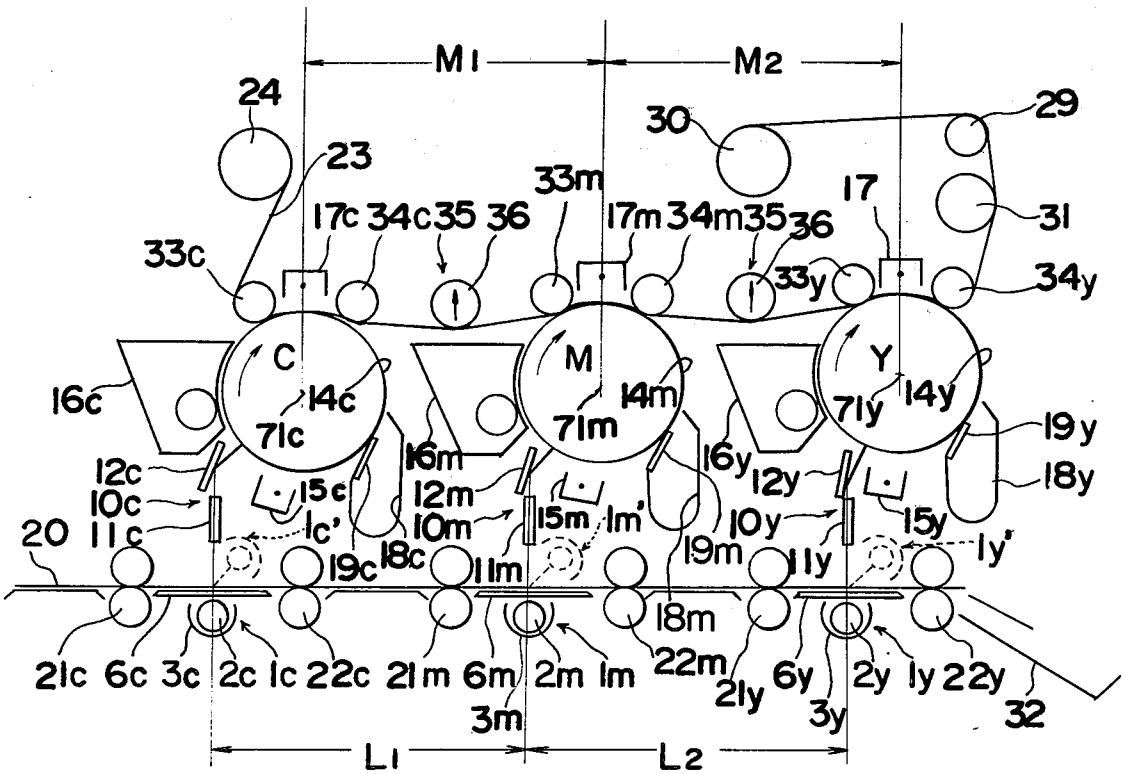
FIG. 3 is a schematic cross-sectional view of an electrophotocopying machine according to a second embodiment of the invention.

Referring now to FIG. 3, according to another embodiment of the invention, the electrophotocopying machine is provided with an adjustment unit for adjusting the length of the copy paper path between successive transfer stations, and is further simplified by employing in the illuminating assemblies illumination lamps 2 emitting light of various wavelengths for production of blue light, there being provided, for example, a lamp emitting light of short wavelength, such as employed for diazo printing. Employment of such light sources makes it unnecessary to provide filters. Alternatively, blue color may be produced by the use of a selenium photosensitive medium, green color by use of a CdS photosensitive medium, and red color by use of an organic photosensitive medium.

The copy paper 23 is moved in effect effective contact with the drum 14*c* at the transfer station of drum 14*c* by a roller 33*c* which in terms of copy paper advance is positioned at the entrance of the transfer station, and a roller 34*c* which is provided at the exit of the transfer station. Similar pairs of rollers 33*m* and 34*m* and 33*y* and 34*y* are provided at the transfer stations of drums 14*m* and 14*y*. In the photocopying machine of FIG. 3, the distances L1 and L2 between successive exposure stations, which are the distances between the central axes of successive optical fiber bundles 11, are made slightly greater than the distances M1 and M2 between successive transfer stations, these distances being taken to be the distances between the axes of rotation of successive drums 14. Also, since this arrangement could otherwise result in these being different optical path lengths in the different exposure assemblies, the axes 71*m* and 71*y* of the drums 14*m* and 14*y* are positioned successively higher above the path of the original than the axis 71*c* of the drum 14*c*. Matching of the lengths of the paths over which copy paper 23 and original documents 20 travel in accordance with quality of paper employed in the photocopying process is achieved by means of an adjustment unit 35 comprising a movable roller 36 which contacts the rear surface of the copy paper 23 and is provided between rollers 34*c* and 33*m*, and a similar unit is provided between rollers 34*m* and 33*y*.

Figure 4:
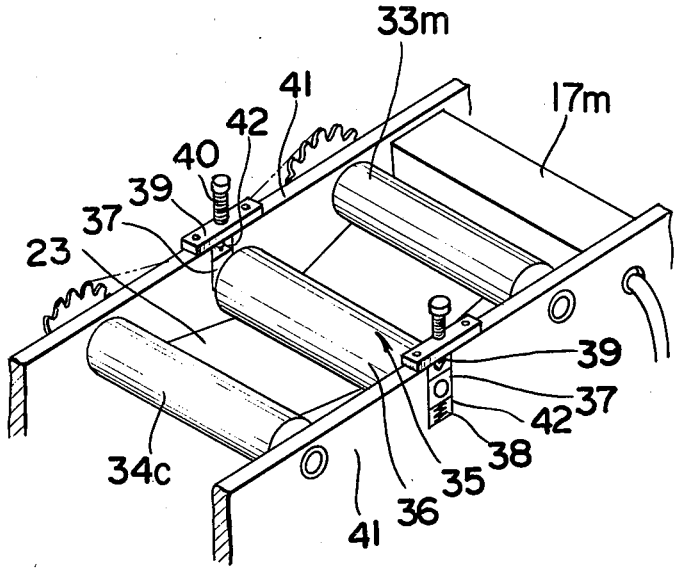
FIG. 4 is a detail perspective view of means provided in the machine of FIG. 3 for adjustment of the length of the copy paper path between transfer stations.

As shown in FIG. 4, the roller 36 of the adjustment unit 35 has the opposite ends thereof rotatably mounted in slide elements 37 which may be slid upwards or downwards in slits 42 provided in opposite side walls 41, by which slide elements the rolls 33 and 34 are rotatably supported. Between the lower surface of each slide element 37 and the bottom of the respective slit 42 there is provided an expansion spring 38, which exerts a force urging the slide element 37, and hence the roller 36, upwards. The upper surface of each slide element 37 is contacted by the lower end of a screw 40 which is threaded through and supported by a bracket 39 fixedly mounted on the respective side wall 41. Thus, the position of the roller 36 may be altered by screwing the screws 40 in greater or lesser distances, the length of the path travelled by copy paper 23 between transfer stations being increased when the roller 36 is moved downwards. In other words, adjustment of the copy paper path length in accordance with paper quality may be effected in a very simple manner.

Figure 5:
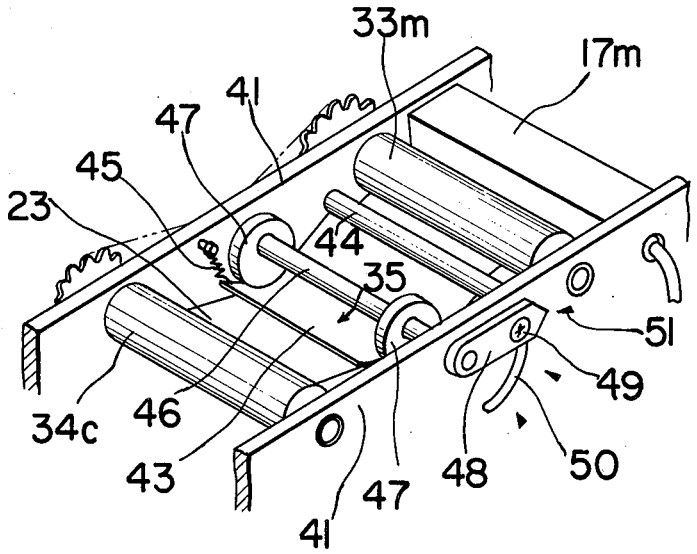
FIG. 5 is a detail perspective view of another means employable in the machine of FIG. 3 for adjustment of the copy paper path length.

Alternatively, as shown in FIG. 5, the path length of copy paper 23 may be varied by a downwardly curved plate 43 the lower surface of which contacts the rear surface of copy paper 23 moving between transfer stations, one end of which is rotatably supported by a shaft 44 extending between and fixedly attached to opposite side walls 41, and the opposite end of which is attached to spring elements 45 which exert a force urging the plate 43 to move upwards, pivoting about the shaft 44. The upper surface of the plate 43 is contacted by eccentric cams 47 mounted on a rotatable shaft 46, which is supported in opposite side walls 41. One end portion of the shaft 46 extends through a side wall 41 and has fixedly attached thereto one end of a positioning lever 48, to the opposite end of which is attached a screw 49 which is slidable in an arcuate groove 50 defined in the side wall 41 and which can be screwed into the groove 50 to fix the positioning lever 48 in a required position, whereby the shaft 46 and cams 47 may be rotated to particular positions and the plate 43 may be moved to adjust the length of the path over which copy paper 23 travels between transfer stations. To make it possible to determine the exact length of this path, the end of the positioning lever 48 to which the screw 49 is attached is made narrower and graduations 51 are marked on the corresponding side wall 41.

Figure 6:
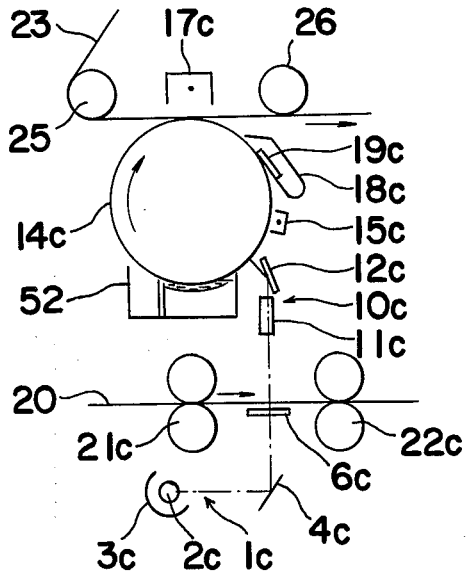
FIGS. 6 and 7 are schematic cross-sectional views showing modifications of the electrophotocopying machine according to the invention.

Referring to FIG. 6, in the photocopying machine of FIG. 1 or of FIG. 3, instead of toner powder being used to develop latent images defined by the photosensitive drums 14, development may be effected by liquid developer units 52 positioned below the drums 14. In this case, if the drums 14 rotate counterclockwise as seen in the drawing, the focussing assemblies 10 must of course be located at the right of their respective drums as seen in the drawing, the principles of construction however remaining unchanged. Needless to say, instead of effecting development of latent images by toner particles or fluid, a photocopying machine having the same basic construction according to the invention described above may be of the type in which direct transfer of electrostatic images onto copy paper is effected.

Figure 7:
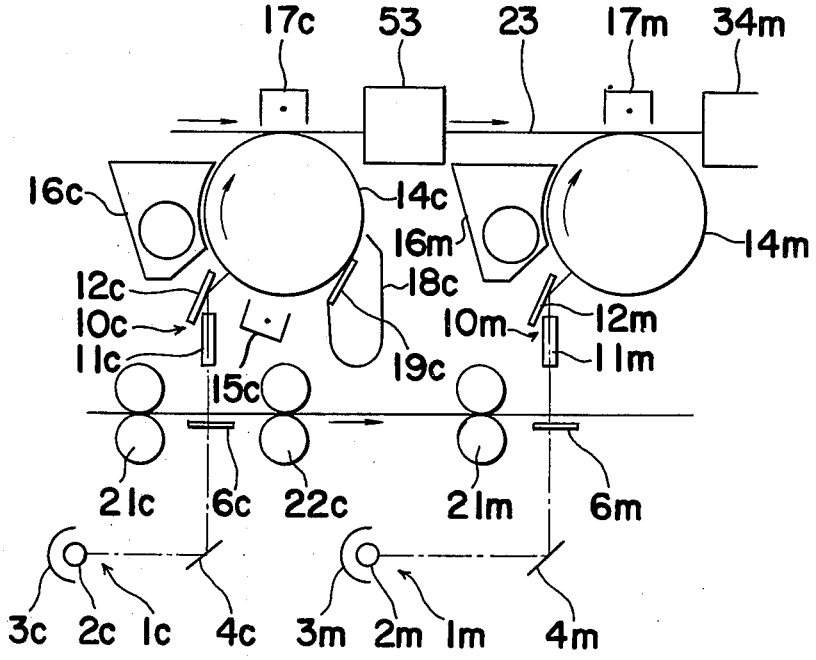

In FIG. 7, if development of images is by toner at successive transfer stations, there may be provided fixing stations 53 to effect at least partial fixing of transferred toner of one color before transfer of other toner.

Although the present invention has been fully described by way of example with reference to the attached drawings, it should be noted that various changes and modifications will be apparent to those skilled in the art. Therefore, unless otherwise such changes and modifications depart from the scope of the present invention, they should be construed as being included therein.

What is claimed is:

1. An electrophotocopying machine comprising:

a plurality of means for production of colored images to be transferred onto a copy paper and respectively corresponding to particular color component portions of an original multicolor document to be copied, each of said production means including a movable photosensitive medium for forming thereon an image of one of said color component portions, focussing means at an exposure station adjacent said photosensitive medium for projecting colored light carrying the image of said original document onto said photosensitive medium, said focussing means including an optical fiber bundle made of a plurality of optical fibers for producing a focussed erect image and an odd number of mirrors for reflecting the image projected by said optical fiber bundle onto said photosensitive medium and developing means adjacent said photosensitive medium for developing the latent image formed on said photosensitive medium for transfer to copy paper;

original document transport means for moving said original document past said focussing means of the plurality of production means synchronously with the movement of the photosensitive medium in each production means;

said photosensitive medium being movable in a path at least part of which is substantially parallel to the path of the original document and in the same direction as the direction of movement of the original document;

image transfer means adjacent the photosensitive medium at a transfer station in each production means which is along said part of said path of said photosensitive medium for transferring said developed image from said photosensitive medium to copy paper at said transfer station;

copy paper transport means for moving copy paper past the transfer stations synchronously with the movement of the original document and in the same direction as the direction in which the original document is moved;

the respective ones of said plurality of production means being positioned next to one another in succession in a line for forming on said copy paper successive single color component portions, the distance between each of the successive exposure stations being greater than the distance between each of the successive transfer stations; and adjustment means adjacent the path of the copy paper for adjusting the length of the path over which said copy paper is transported between said transfer stations of said production means, whereby said copy paper is synchronously and continuously moved in the same direction as said original document through said plurality of production means, said adjustment means comprising a roller, slide elements in which the opposite ends of said roller are rotatably mounted, said photocopying machine having fixed wall portions having slots therein in which said slide elements are slidable, and a screw and spring means on opposite sides of said slides, said screws being externally adjustable for moving said slides against the action of said springs.

2. An electrophotocopying machine comprising:

a plurality of means for production of colored images to be transferred onto a copy paper and respectively corresponding to particular color component portions of an original multicolor document to be copied, each of said production means including a movable photosensitive medium for forming thereon an image of one of said color component portions, focussing means at an exposure station adjacent said photosensitive medium for projecting colored light carrying the image of said original document onto said photosensitive medium, said focussing means including an optical fiber bundle made of a plurality of optical fibers for producing a focussed erect image and an odd number of mirrors for reflecting the image projected by said optical fiber bundle onto said photosensitive medium, and developing means adjacent said photosensitive medium for developing the latent image formed on said photosensitive medium for transfer to copy paper;

original document transport means for moving said original document past said focussing means of the plurality of production means synchronously with the movement of the photosensitive medium in each production means;

said photosensitive medium being movable in a path at least part of which is substantially parallel to the path of the original document and in the same direction as the direction of movement of the original document;

image transfer means adjacent the photosensitive medium at a transfer station in each production means which is along said part of said path of said photosensitive medium for transferring said developed image from said photosensitive medium to copy paper at said transfer station;

copy paper transport means for moving copy paper past the transfer station synchronously with the movement of the original document and in the same direction as the direction in which the original document is moved;

the respective ones of said plurality of production means being positioned next to one another in succession in a line for forming on said copy paper successive single color component portions, the distance between each of the successive exposure stations being greater than the distance between each of the successive transfer stations; and adjustment means adjacent the path of the copy paper for adjusting the length of the path over which said copy paper is transported between said transfer stations of said production means, whereby said copy paper is synchronously and continuously moved in the same direction as said original document through said plurality of production means, said adjustment means comprising plate means, a fixed shaft in said machine on which one end of said plate means is rotatably mounted, spring means attached to the opposite end of said plate means and urging said plate means in one rotational direction around said fixed shaft, cam elements rotatably mounted on said machine and engagable with said plate means to move said plate means rotatably against the force of said spring means, and externally actuable means connected to said cam elements for rotating said cam elements.

3. An electrophotocopying machine comprising:

a plurality of means for production of colored images to be transferred onto a copy paper and respectively corresponding to particular color component portions of an original multi-color document to be copied, each of said production means including a movable photosensitive medium for forming thereon an image of one of said color component portions, focussing means at an exposure station adjacent said photosensitive medium for projecting colored light carrying the image of said original document onto said photosensitive medium, said focussing means including an optical fiber bundle made of a plurality of optical fibers for producing a focussed erect image and an odd number of mirrors for reflecting the image projected by said optical fiber bundle onto said photosensitive medium;

original document transport means for moving said original document past said focussing means of the plurality of production means synchronously with the movement of the photosensitive medium in each production means;

said photosensitive medium being movable in a path at least part of which is substantially parallel to the path of the original document and in the same direction as the direction of movement of the original document;

image transfer means adjacent the photosensitive medium at a transfer station in each production means which is along said part of said path of said photosensitive medium for transferring said image from said photosensitive medium to copy paper at said transfer station;

copy paper transport means for moving copy paper past the transfer stations synchronously with the movement of the original document and in the same direction as the direction in which the original document is moved;

the respective ones of said plurality of production means being positioned next to one another in succession in a line for forming on said copy paper successive single color component portions;

the distance between each of the successive exposure stations being greater than the distance between each of the successive transfer stations; and adjustment means adjacent the path of the copy paper for adjusting the length of the path over which said copy paper is transported between said transfer stations of said production means, whereby said copy paper is synchronously and continuously moved in the same direction as said original document through said plurality of production means, said adjustment means comprising a roller, slide elements in which the opposite ends of said roller are rotatably mounted, said photocopying machine having fixed wall portions having slots therein in which said slide elements are slidable, and a screw and spring means on opposite sides of said slides, said screws being externally adjustable for moving said slides against the action of said springs.

4. An electrophotocopying machine comprising:

a plurality of means for production of colored images to be transferred onto a copy paper and respectively corresponding to particular color component portions of an original multi-color document to be copied, each of said production means including a movable photosensitive medium for forming thereon an image of one of said color component portions, focussing means at an exposure station adjacent said photosensitive medium for projecting colored light carrying the image of said original document onto said photosensitive medium, said focussing means including an optical fiber bundle made of a plurality of optical fibers for producing a focussed erect image and an odd number of mirrors for reflecting the image projected by said optical fiber bundle onto said photosensitive medium;

original document transport means for moving said original document past said focussing means of the plurality of production means synchronously with the movement of the photosensitive medium in each production means;

said photosensitive medium being movable in a path at least part of which is substantially parallel to the path of the original document and in the same direction as the direction of movement of the original document;

image transfer means adjacent the photosensitive medium at a transfer station in each production means which is along said part of said path of said photosensitive medium for transferring said image from said photosensitive medium to copy paper at said transfer station;

copy paper transport means for moving copy paper past the transfer stations synchronously with the movement of the original document and in the same direction as the direction in which the original document is moved;

the respective ones of said plurality of production means being positioned next to one another in succession in a line for forming on said copy paper successive single color component portions;

the distance between each of the successive exposure stations being greater than the distance between each of the successive transfer stations; and adjustment means adjacent the path of the copy paper for adjusting the length of the path over which said copy paper is transported between said transfer stations of said production means, whereby said copy paper is synchronously and continuously moved in the same direction as said original document through said plurality of production means, said adjustment means comprising plate means, a fixed shaft in said machine on which one end of said plate means is rotatably mounted, spring means attached to the opposite end of said plate means and urging said plate means in one rotational direction around said fixed shaft, cam elements rotatably mounted on said machine and engageable with said plate means to move said plate means rotatably against the force of said spring means, and externally actuable means connected to said cam elements for rotating said cam elements.

* * * * *